United States Patent [19]

de Jager

[11] 4,407,420

[45] Oct. 4, 1983

[54] SHIP COMPRISING ONE OR MORE DERRICKS SUCH AS A DREDGE WITH SUCTION PIPE DERRICKS

[75] Inventor: Arie de Jager, Sliedrecht, Netherlands

[73] Assignee: IHC Holland N.V., Papendrecht, Netherlands

[21] Appl. No.: 289,382

[22] Filed: Aug. 3, 1981

[30] Foreign Application Priority Data

Aug. 4, 1980 [NL] Netherlands ..... 8004436

[51] Int. Cl.[3] ..... B66C 23/18

[52] U.S. Cl. ..... 212/199; 37/72; 414/140

[58] Field of Search ..... 114/210, 368, 369, 373, 114/372, 375, 254, 257, 258; 212/199; 414/140; 37/65, 72; 187/6

[56] References Cited

U.S. PATENT DOCUMENTS

| | | | |
|---|---|---|---|
| 2,651,122 | 9/1953 | Brinkman . | |
| 2,933,837 | 4/1960 | Nelson . | |
| 3,943,875 | 3/1976 | Sanders | 114/244 |
| 4,080,920 | 3/1978 | Berthet et al. | 114/254 X |

FOREIGN PATENT DOCUMENTS

| | | | |
|---|---|---|---|
| 1294897 | 8/1969 | Fed. Rep. of Germany . | |
| 24392 | 7/1929 | Netherlands . | |
| 73029 | 7/1953 | Netherlands . | |
| 750669 | 6/1956 | United Kingdom | 37/72 |

*Primary Examiner*—Sherman D. Basinger
*Attorney, Agent, or Firm*—Young & Thompson

[57] ABSTRACT

The invention relates to a ship (1) with one or more derricks (4), in particular a dredge having at least one derrick (4) for handling the suction pipe (22) which derrick (4) can be moved between an inboard position (7) and a vertical position. The derrick has guiding tracks (8,9) for a crane jib (17) which tracks (8,9) in the vertical position of the derrick (4) are in line with guiding tracks (15,16) inside the profile of the side wall (3) of the ship. The cable for controlling the jib (17) is protected by a channel inside the profile of the ship side wall (3) between the latter guiding tracks (15,16). The guiding tracks (8,9,15,16) have upper and lower stops (29,28) for controlling the movements of the crane jib (17) which jib (17) is pivotable about a horizontal axis (18) between a position perpendicular to the derrick (4) and a downwardly directed position.

8 Claims, 3 Drawing Figures

SHIP COMPRISING ONE OR MORE DERRICKS SUCH AS A DREDGE WITH SUCTION PIPE DERRICKS

BACKGROUND OF THE INVENTION

The invention relates to a ship comprising one or more derricks positioned on deck along the side of the ship, which derricks have push-pull-mechanism, such as a cylinder, for swinging the respective derrick around a horizontal axis from an inboard position to a position in which a load can be lowered outboard and vice versa, such as the derrick for the suction pipe of a dredge, which derrick cooperates with a winch of which the hoisting cable runs over one or more pulleys to a load carrying hoist block such that said hoist block is situated outboard in the working position of said derrick. Such a ship is commonly known. The derrick of a ship of this type can swivel between an oblique inwards directed resting position and an oblique outwards directed working position in which a load outboard at a distance of the ship's hull can be handled.

If the load is embodied as a suction pipe used for carrying out dredging operations, then it is often necessary to lower said pipe to a considerable depth under water whereby, especially in troublesome currents or high seas, the danger exists that the hoisting cables and the load hanging thereon such as the suction pipe can come into conflict with the ship's hull. Furthermore the danger exists that the hoisting cables are damaged by bodies floating in or on the water such as ice floes.

An object of the invention is now to provide a ship comprising one or more derricks, especially a ship comprising derricks for handling a suction pipe, whereby the danger of damaging the hoisting cables is eliminated and furthermore it is prevented that the load will come into conflict with the ship's hull.

SUMMARY OF THE INVENTION

According to the invention that object is primarily reached in that said derrick comprises at the outboard directed side guiding tracks for a sliding piece carrying a crane jib, and the hull of said ship comprises inwards of the shell also guiding tracks running over the total height of the ship's side wall, which guiding tracks of said derrick are in the working position of said derrick aligned with and connected to the guiding tracks on the ships hull, whereby between or besides said guiding tracks of the derrick and the ship a channel C for a hoisting cable connected to said sliding piece is installed in the ship side wall area inside the ship's hull.

With this embodiment of ship and derrick it is attained that the load suspended from the crane jib during the upwards or downwards movement of said sliding piece carrying said crane jib, always is kept at a fixed distance from the ships hull. Furthermore it is attained that the cables are situated in a channel C inwards of the shell of said hull, so that there is no chance that said cable is damaged by ice floes. It is also possible that said sliding piece with said crane jib is moved by means of a separate hoisting cable and corresponding winch over said guiding tracks of the derrick and the ship's hull, in which case the hoist block carried by said crane jib has a separate hoisting cable running over guiding pulleys and through the channel and over said derrick to a separate corresponding winch. Said guiding tracks can have stop means near the upper end of said derrick and near the under side of the side wall of the ship's hull, which stop elements are generally useful but have a special meaning when, according to the invention, the crane jib is pivotably connected to said sliding piece by means of a horizontal shaft, directed essentially parallel to the longitudinal direction of the ship, which sliding piece has a stop element restricting the upward movement of said crane jib around said horizontal shaft, whereby the hoisting cable runs over a top pulley, through said channel and over a guiding pulley of said sliding piece, which guiding pulley extends into said channel towards said hoist block and runs back to a fixed point on said sliding piece, whereby said hoist block is supported in an outwards open bifurcated part of said crane jib, whereby the supporting point is positioned above the pivot shaft of said crane jib in the situation in which said crane jib is arrested by said stop element.

Thereby it is attained that the crane jib during lowering of said crane jib carrying sliding piece is maintained in an outwards directed horizontal position arrested against the stop element of said sliding piece, until said sliding piece has reached the lower stop means. When the load cable runs out further, than the crane jib swivels around the horizontal axis to the downwards directed position in which the hoist block is able to leave the bifurcated crane jib part so that the load, for instance the suction pipe can be lowered further.

During raising of the load said hoist block is received into said bifurcated crane jib part, after which the crane jib swivels upwards as a result of the lever action between the supporting point in said bifurcated part and the horizontal shaft of the crane jib, until the crane jib is arrested in the horizontal position against the stop element in the sliding piece whereafter, during further raising of the load, also said sliding piece carrying said crane jib will move upwards. Said movement is continued until the sliding piece is arrested by the upper stop means near the end of the derrick. In this position a locking device can be activated, after which the hoisting winch can be switched off. Using a double active cylinder the derrick can be turned over to the inboard position and by running out the hoisting cable said crane jib may be swiveled into a position in which the thereon hanging suction pipe is lowered into a supporting saddle.

When the suction pipe has to be brought out again, then the hoisting cable is turned in, the crane jib raises the suction pipe from the supporting saddle until said crane jib is arrested against the stop element, after which the derrick is turned over outwards to the vertical position.

THE DRAWINGS

The invention will now be explained in more detail with reference to the attached drawings.

DETAILED DESCRIPTION

Figure 1:
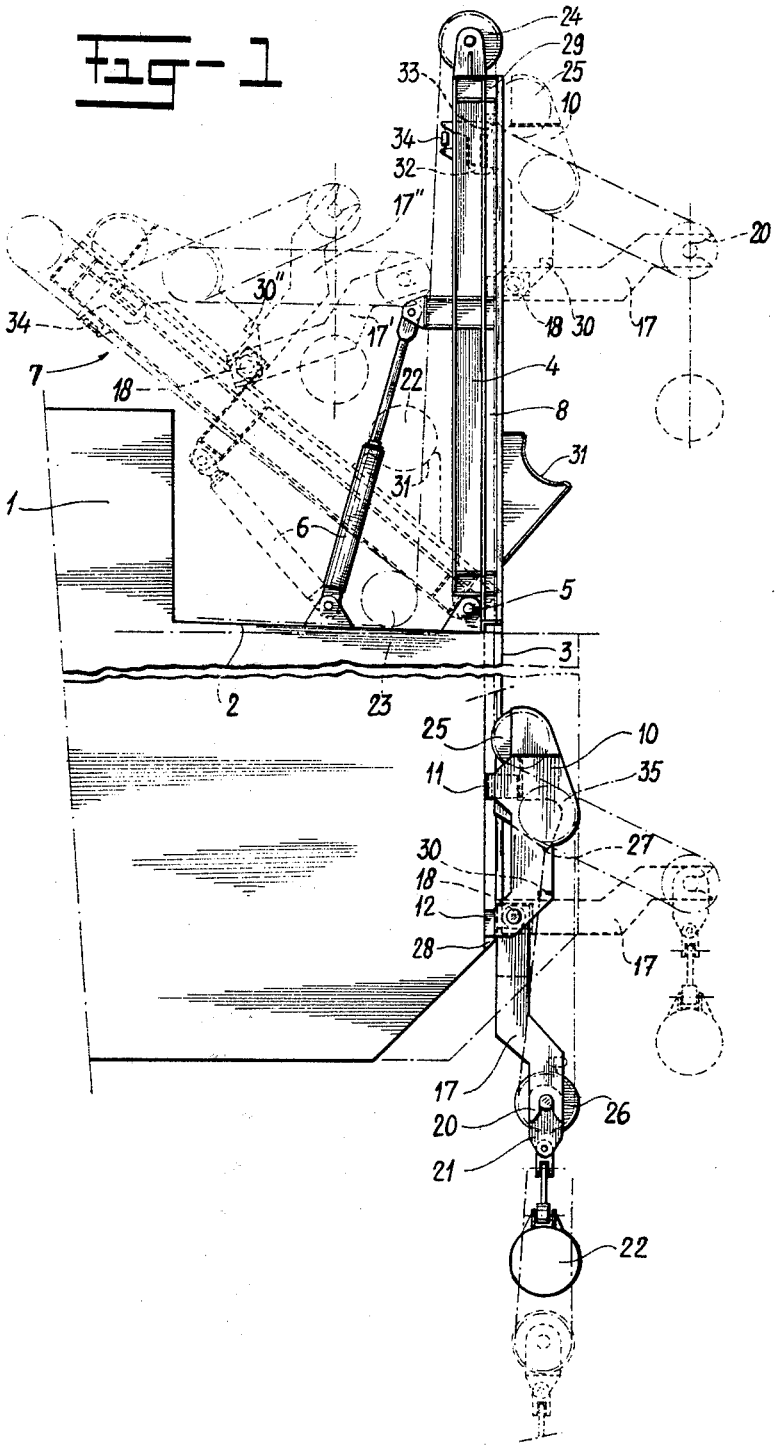
FIG. 1 illustrates a transverse sectional view of part of a ship carrying the derrick shown in several positions.
Figure 2:
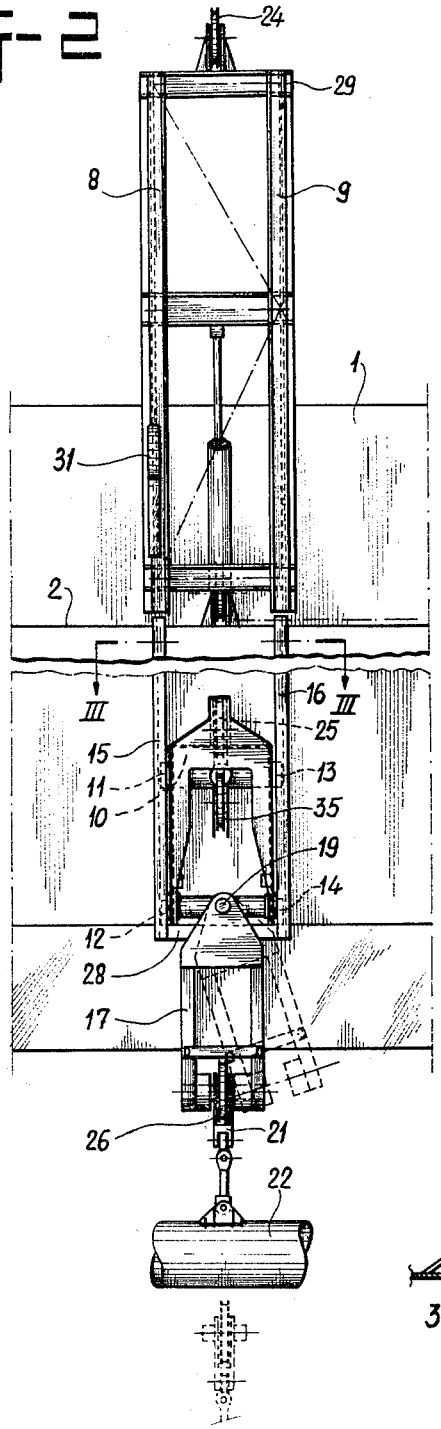
FIG. 2 illustrates a side view of the ship in FIG. 1 wherein the hoist block is in the lowest position.

FIG. 1 shows part of the ship 1 comprising a deck 2 and a side wall 3. A number of derricks 4 are installed on the deck, one of which is illustrated in FIGS. 1 and 2. Said derrick is at 5 pivotably connected to the ships deck and can be moved by means of a pressure cylinder 6 between the inboard position 7 illustrated by means of dash and dot lines and the working position illustrated with full lines. Said derrick carries guiding tracks 8 and 9, in which a sliding piece 10 is guided by means of sidewards extending sliding blocks 11, 12, 13 and 14.

Figure 3:
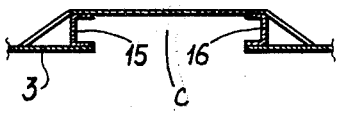
FIG. 3 shows a sectional view according to the line III—III in FIG. 2.

Further guiding tracks 15 and 16 are installed in the side wall of the ship's hull, which guiding tracks are positioned inwards of the ship's shell as is illustrated in FIG. 3. Said guiding tracks 15 and 16 are aligned with the guiding tracks 8 and 9 of the derrick 4 when said derrick is in the erected vertical working position. In that case it is possible for said sliding piece 10 to be transfered from the guiding tracks 8 and 9 into the guiding tracks 15 and 16.

The sliding piece 10 carries a crane jib 17 which is at 18 pivotably connected by means of a universal joint having a horizontal axis 18 and perpendicular thereto a further axis 19.

The end of the crane jib is embodied as a bifurcated part denoted with 20, in which the hoist block 21 is supported comprising means for carrying the load 22, which in the illustrated example is embodied as a suction pipe.

On deck a winch 23 is installed the cable of which runs over the top pulley 24 of the derrick, over the guiding pulley 25 of the sliding piece 10, from there to the pulley 26 of the hoist block 21 and further to a fixed point 27 onto said sliding piece.

The guiding tracks 15 and 16 have a stop element 28 at their lower end and the guiding tracks 8 and 9 have a stop element 29 at their upper end.

The crane jib 17 is in the outwards swiveled position illustrated in the upper part of FIG. 1, arrested by stop means 30 in said sliding piece restricting the upwards movement, which stop means 30 are embodied such that they also restrict sideward movements around the pivot shaft 19 of the universal joint.

The derrick 4 has a supporting yoke or saddle 31 for the suction pipe 22.

In the upper section of the derrick a locking element 32 is installed which is able to reach under the cross beam of the sliding piece 10, and which locking element 32 can rotate around the shaft 33 and can be operated by means of the air pressure cylinder 34.

Starting from the resting position, illustrated with dots and dash lines in the left hand side of FIG. 1, in which the suction pipe 22 rests in the supporting saddle 31, reeling in the hoisting cable of the winch 23 will result in raising the suction pipe 22 from the saddle 31, whereupon the crane jib will swivel from the position 17' to the position 17'' until said jib is arrested by the stop element 30 on the sliding piece.

Thereafter the derrick is brought into the vertical position by means of the cylinder 6 and when the hoisting cable is kept short then it is possible to pull the locking device 32 using the cylinder 34, whereafter by means of the winch the sliding piece can be moved downwards through the guiding tracks 8 and 9, whilst the crane jib is maintained in the horizontal position as illustrated in the upper right part of FIG. 1. The reason for this is, that the crane jib carrying the load is maintained against the stop element of the sliding piece by two sections of the hoist cable. The pulling force acting on the crane jib is therefore approximately twice the total force in the hoisting cable, whereas only once the total force in the hoisting cable is equal to the force necessary to move said sliding piece, crane jib and load downwards or upwards.

When said sliding piece is lowered further then it will be transferred from the guiding tracks 8 and 9 into the guiding tracks 15 and 16, until the lowest position illustrated with full lines in FIG. 1 is reached. In this position the sliding piece is arrested against the stop element 28.

During the whole of this movement and during maintaining of the lowest position the hoisting cable is protected between said guiding tracks 15 and 16 so that said cable cannot be damaged by bodies floating in the water.

As soon as the sliding piece is arrested against the stop element 28 further paying out of the hoisting cable will result in a downwards swiveling movement of the crane jib to the position which with full lines is illustrated in FIGS. 1 and 2. If, after reaching this situation the hoisting cable is further payed out, then the hoist block 21 will leave the fork 20 and will move downwards as is illustrated with the dash and dot lines in the lower half of FIG. 1.

During said downwards swiveling movement the hoisting cable is guided by an additional guiding pulley 35.

In said downwards directed position the crane jib is also arrested against the stop element 28, but as result of the installation of a universal joint 18, 19 said crane jib is able to follow all the movements of the hoisting cable and the load as is illustrated in the lower part of FIG. 2 by the dash and dot lines.

Because the fork 20 of the crane jib 17 is shifted in relation to the pivot shaft 18, that means that in the transversely outwards directed position illustrated in the upper right part of FIG. 1 said fork is positioned above said pivot joint, there is a lever acting between the end of said crane jib and said pivot joint 18 which assures, that during raising of the load said crane jib will swivel from the vertical position back upwards into the horizontal position. During the return movement the sliding piece moves with the crane jib in the horizontal position upwards until it is arrested against the stop element 29 after which it is fixed by means of the locking device.

After moving the derrick 4 back to the inboard position 7, paying out of the hoisting cable will result in bringing the crane jib into position 17', in which the pipe 22 will come to rest on the supporting saddle 31.

Instead of only one hoisting cable for carrying out all the described movements, also an embodiment, in which a separate cable with corresponding winch is used as hoisting cable for the load and another separate cable with corresponding winch is used for moving the sliding piece, falls within the scope of the invention.

In said single hoisting cable or in said separate load cable a swell compensator can be installed.

I claim:

1. In a ship having a derrick on deck along a side of the ship to handle the suction tube of a dredge, means mounting the derrick for vertical swinging movement about a horizontal axis from an inboard position toward a position in which the suction tube can be lowered outboard and vice versa, means for swinging the derrick about said horizontal axis, a hoisting winch having a hoisting cable, a hoist block for carrying the suction tube, said hoist block being disposed outboard in the latter said position of said derrick, pulleys about which said cable extends to said hoist block, guiding tracks on said derrick, guiding tracks on the hull of the ship, and a sliding piece slidable along the guiding tracks on said derrick and on said ship between an upper position on the guiding tracks of said derrick and a lower position on the guiding tracks of said ship; the improvement comprising a crane jib on said sliding piece having an outer end carrying said hoisting block, said guiding tracks on the hull of the ship being disposed within the profile of the side wall of the ship, and said cable having a portion disposed between the guiding tracks of the derrick and between the guiding tracks of the ship inwardly of the profile of said side wall of the ship when said sliding piece is in said lower position.

2. Ship according to claim 1, in which said guiding tracks have stop means near the upper end of the derrick and near the under side of the side wall of the ships hull.

3. Ship according to claim 2, in which in the upper end of said derrick near said stop means an on and off switchable locking device for the sliding piece is installed.

4. Ship according to claim 1, in which the crane jib is pivotably connected to said sliding piece by means of a horizontal shaft, directed essentially parallel to the length direction of the ship, which sliding piece has a stop element restricting the upwards movement of said crane jib around said horizontal shaft, whereby the hoist cable runs over a top pulley on said derrick, between said guide tracks and over a guiding pulley of said sliding piece, which guiding pulley extends between said guiding tracks, to said hoist block and runs back to a fixed point on said sliding piece, whereby said hoist block is supported in an outwards open bifurcated part of said crane jib, whereby the supporting point is positioned above the pivot shaft of said crane jib, in the situation in which said crane jib is arrested by said stop element.

5. Ship according to claim 4, in which said crane jib is connected to said sliding piece by means of a universal joint, and said sliding piece comprises sidewards acting stop elements for restricting the transverse movement of said crane jib around said universal joint in the situation in which said crane jib is arrested by said sliding piece stop element which restricts the upward movement.

6. A ship according to claim 1, in which said guiding tracks on the ship are straight and vertical.

7. A ship according to claim 1, in which the ship is elongated and said horizontal axis extends parallel to the length of the ship.

8. A ship according to claim 1, and means mounting said crane jib on said sliding piece for vertical swinging movement about a horizontal axis disposed parallel to the first-mentioned horizontal axis.

* * * * *